US007585562B2

(12) United States Patent
Hasui et al.

(10) Patent No.: US 7,585,562 B2
(45) Date of Patent: Sep. 8, 2009

(54) PRESTRESSING STRAND HAVING CORROSION PROTECTION DOUBLE COATINGS

(75) Inventors: Takeshi Hasui, Hokkaido (JP); Takatsugu Fujikawa, Hokkaido (JP)

(73) Assignee: Kurosawa Construction Co., Ltd., Tokyo (JP)

( * ) Notice: Subject to any disclaimer, the term of this patent is extended or adjusted under 35 U.S.C. 154(b) by 2 days.

(21) Appl. No.: 11/704,930

(22) Filed: Feb. 12, 2007

(65) Prior Publication Data

US 2007/0141336 A1 Jun. 21, 2007

Related U.S. Application Data

(62) Division of application No. 10/865,884, filed on Jun. 14, 2004, now Pat. No. 7,241,473.

(30) Foreign Application Priority Data

Jun. 18, 2003 (JP) ..... 2003-173275

(51) Int. Cl.
*D02G 3/36* (2006.01)
*D02G 3/22* (2006.01)
*E04C 5/08* (2006.01)

(52) U.S. Cl. ..... 428/378; 428/375; 428/377; 428/379; 428/383; 57/210; 57/217; 57/221; 57/223; 57/232; 52/223.1; 52/223.14; 52/857

(58) Field of Classification Search ..... None
See application file for complete search history.

(56) References Cited

U.S. PATENT DOCUMENTS

| | | | | |
|---|---|---|---|---|
| 4,401,479 | A * | 8/1983 | Quick | 148/287 |
| 5,208,077 | A | 5/1993 | Proctor et al. | |
| 5,263,307 | A * | 11/1993 | Hasui | 57/221 |
| 5,362,326 | A | 11/1994 | Hasui et al. | |
| 6,200,678 | B1 * | 3/2001 | Hunt et al. | 428/371 |
| 2004/0258915 | A1 * | 12/2004 | Hasui et al. | 428/375 |
| 2007/0141336 | A1 * | 6/2007 | Hasui et al. | 428/375 |

FOREIGN PATENT DOCUMENTS

JP 11-200267 7/1999

* cited by examiner

*Primary Examiner*—Jill Gray
(74) *Attorney, Agent, or Firm*—Wenderoth, Lind & Ponack, L.L.P.

(57) ABSTRACT

To improve tensile strength without impairing flexibility and adhesion to concrete, and to form a thick coating in a surface layer part for preventing a basis material from being exposed by damage to the coating, a method of forming double coatings on a prestressing strand includes a primary painting process after a pre-treatment process, in which a resin coating is formed only at the surface layer, a secondary painting process in which respectively individual state resin coating is formed on an outer peripheral face of each of the core wire and surrounding wires under a loosened and separated state, thereby forming a double coating for each surrounding wire, and a finishing process of tightening and retwisting the surrounding wires about the core wire to an original state. The obtained prestressing strand has the double coating portions only at the surface layer and sufficient flexibility and adhesion to concrete.

2 Claims, 6 Drawing Sheets

PRESTRESSING STRAND HAVING CORROSION PROTECTION DOUBLE COATINGS

This application is a divisional application of application Ser. No. 10/865,884, filed Jun. 14, 2004, now U.S. Pat. No. 7,241,473.

BACKGROUND OF THE INVENTION

1. Field of the Invention

The present invention relates to a method of forming synthetic resin powder paint coating on a prestressing strand used as tensioning members for a post-tensioning system or a pre-tensioning system of a prestressed concrete structure in a building structure or a civil engineering structure, i.e., a method of forming corrosion protection coating. In particular, it relates to a method of forming double coatings only on a surface layer part in case there is a fear of damage of corrosion protection coating on a prestressing strand in a special structure, and a prestressing strand obtained by this method.

2. Related Art

Generally, the prestressing strand has a structure in which fine surrounding wires are twisted around a core wire. This is for giving flexibility to the prestressing strand, and for obtaining adhesion strength to a concrete by means of helical groove parts formed by twisting the surrounding wires. Accordingly, also as a method of forming corrosion protection coating on the prestressing strand, there is desired a method which does not hinder the above properties. At present, several methods have become publicly known or well known as the method of forming corrosion protection coating on the prestressing strand.

A 1st prior art method utilizes a prestressing strand whose sectional shape is shown in FIG. 10. A method of forming corrosion protection coating for this prestressing strand is one in which first the prestressing strand is heated, surrounding wires 1*b* are temporarily untwisted from the circumference of a core wire 1*a* by a strand opener, the untwisted surrounding wires 1*b* untwisted are again returned to an original twisted state in a place where untwisted portions of the surrounding wires 1*b* enter into an electrostatic powder painting machine by 15 inches to 18 inches, a resin 50 during melting and adhering to (during gel time) the core wire 1*a* and the surrounding wires 1*b* is moved (caused to flow) to and filled in void portions between the core wire 1*a* and the surrounding wires 1*b* by twisting stresses of the surrounding wires 1*b*, and additionally, in order to prevent pinholes generated in the helical groove parts formed by twisting the surrounding wires 1*b*, a thick coating 51 (500-600 μm) is formed to make inner and outer parts monolithic, thereby obtaining a composite body (U.S. Pat. No. 5,208,077).

Further, a 2nd prior art method utilizes a prestressing strand whose sectional shape is shown in FIG. 11. The method of forming corrosion protection coating for this prestressing strand is one in which, after a surface preparation, the surrounding wires 1*b* of the prestressing strand are temporarily untwisted in order from the circumference of the core wire 1*a* by use of a loosening-and-untwisting device, the surrounding wires 1*b* are kept apart from the core steel wire 1*a* in a spacing necessary for a next process by a wire expander, the core wire 1*a* passes through a corelength adjusting device, and a synthetic resin powder paint is individually sprayed onto the whole outer peripheral face of each of the core wire 1*a* and the surrounding wires 1*b* by an electrostatic painting method and adhered by an electrostatic repulsive force, thereby forming a resin coating 52. It is a method of forming corrosion protection coating in which the powder paint adhered by the electrostatic repulsive force is heated and molten, forms the individual resin coating 52 by cooling after elapse of the gel time and a curing and standing time, and thereafter the untwisted surrounding wires 1*b* are twisted with respect to the core wire 1*a* to the original state by a tightening device (U.S. Pat. No. 5,362,326).

In the prestressing strand formed in this manner, since the coating is individually formed one by one over the whole outer peripheral face of each of the core wire 1*a* and the surrounding wires 1*b*, which is different than 1st prior art method, the properties, such as the flexibility and the adhesion strength to the concrete, demanded as the prestressing strand are not hindered at all and, moreover, a corrosion protection function is sufficient, so that it is evaluated that this corrosion protection method is an ultimate corrosion protection method for the prestressing strand.

Further, the prestressing strand in which the individual corrosion protection coating is formed on the whole outer peripheral face of each of the core wire 1*a* and the surrounding wires 1*b* by the corrosion protection method according to the 2nd prior art is excellent also in its tensile strength, and this excellent property conspicuously appears especially in a case where a stress amplitude is large. One example of test results when it is subjected to tensile fatigue tests under the same conditions as a usual prestressing strand before the corrosion protection working was as shown below.

TABLE 1

Tensile fatigue test results (specification value $2 \times 10^6$ times)

| Kind of prestressing strand | | Upper limit stress (Pu × 0.45) σ max Kgf/mm² (tf) | Lower limit stress (Pu × 0.45 − 25) σ min Kgf/mm² (tf) | Stress amplitude Δσ Kgf/mm² (tf) | Test results: Final number of repetitions N | Test results: Number of ruptured strand(s) Piece(s) | Test results: Pressure bonding grip deformation Existence |
|---|---|---|---|---|---|---|---|
| Prestressing strand before corrosion protection treatment (15.2 mm) | 1 | 86(12) | 61(8.5) | 25(8.5) | $21.0 \times 10^4$ | 2 | none |
| | 2 | 86(12) | 61(8.5) | 25(8.5) | $28.3 \times 10^4$ | 1 | none |
| | 3 | 86(12) | 61(8.5) | 25(8.5) | $36.6 \times 10^4$ | 3 | none |
| Method of US-A-5362326 (15.2 mm) | 1 | 86(12) | 61(8.5) | 25(8.5) | $400 \times 10^4$ | no rupture | none |
| | 2 | 86(12) | 61(8.5) | 25(8.5) | $400 \times 10^4$ | no rupture | none |
| | 3 | 86(12) | 61(8.5) | 25(8.5) | $400 \times 10^4$ | no rupture | none |

As apparent from the above test results (Table 1), it is understood that, among the general prestressing strand to which no corrosion protection treatment is applied and the prestressing strand which is described in U.S. Pat. No. 5,362,326 in which the individual corrosion protection coating is formed on the whole outer peripheral face of each of the core wire and the surrounding wires, the one in which the corrosion protection coating is formed is remarkably improved with respect to its tensile strength.

As a main factor of this, the fact is recognized that, by forming the individual coating on the whole outer peripheral face of each of the core wire and the surrounding wires, a portion where a metal-to-metal contact occurs is completely nullified, so that it becomes possible to prevent fretting corrosion, contact corrosion and the like. With such a corrosion protection method, not only is a corrosion protection function remarkably improved but also the tensile strength is remarkably improved. Accordingly, in this prestressing strand, in the case where the individual coating is formed on the whole outer peripheral face of each of the core wire and the surrounding wires, it is desirable that a thickness of the coating of each of the core wire and the surrounding wires is made about 250 μm of a range in which a helical constitution of the twisted surrounding wires is stably held and a twisted state is sufficiently maintained.

In the industry, a regulation of the thickness of this kind of coating is accomplished as follows in outline. Namely, according to many research results, it is reported that, in order to satisfy a corrosion resistance performance and dynamic performances (impact resistance, bending property, and ability to adhere to concrete), the coating thickness of 200±50 μm is adequate if a powder type epoxy resin painting is adopted. Further, also in experimental results of the FHWA (Federal Highway Administration) in the U.S.A, it is reported that a range of 170±50 μm is desirable.

Additionally, an article to be painted with a coating thickness under this regulation is "Steel Bar for Ferroconcrete under JIS G 3112 (Japanese Industrial Standards)" (deformed steel bar), and is one completely different from a round steel bar. And, it is one having protrusions (ribs) on its surface in an axial direction, and having protrusions (nodes) also in a direction other than the axial direction, so that the above regulation of the coating thickness is determined by sufficiently considering the fact that the article to be coated has a structure in which, in the protrusion portions, there are many corner places where the powder paint is difficult to adhere.

Accordingly, in a case of a simple round steel bar shape like the core wire and the surrounding wires in the prestressing strand, since the powder paint evenly adheres to its outer peripheral face, it is needless to say that there is no problem so long as the coating thickness is 200±50 μm.

Additionally, a 3rd prior art method utilizes a prestressing strand whose sectional shape is shown in FIG. 12. This prestressing strand is made for a case where there is a fear that the corrosion protection coating will be damaged by a special structure and thus a maximum coating thickness of 250 μm or more by which the coating can be stably held is demanded, and a double coating corrosion protection working is performed, with respect to the prestressing strand of the 2nd prior art, by additionally forming a thick resin coating 53 on its outer peripheral face (JP-A-11-200267)

In the 1st prior art, since it is the prestressing strand made monolithic in which the resin powder is moved (caused to flow) to and filled in the void portions between the core wire and the surrounding wires by the stresses twisting the surrounding wires during when the resin powder is molten and adhered to (during gel time) the core wire and the surrounding wires and the thick coating is formed also in the surface layer part, the flexibility demanded to the prestressing strand cannot be expected at all. Further, since it is not only impossible to expect an improvement in the tensile strength, but also the helical groove part due to twisting the surrounding wires becomes shallow, there arises a problem that the adhesion strength to the concrete is reduced.

Additionally, this prestressing strand is one in which the resin is filled in the internal spaces. However, it has a structure in which basis surfaces still contact each other in contact portions between the core wire and the surrounding wires and between the mutual surrounding wires, so that no corrosion protection coatings are formed between the core wire and the surrounding wires and between the mutual surrounding wires, and thus it cannot be said that a problem of so-called internal corrosion is solved.

Further, in the 2nd prior art method, the structure has the individual resin coating formed in each of the core wire and the surrounding wires of the prestressing strand. It is possible to expect improvements in the flexibility and the tensile strength demanded of the prestressing strand. However, in its corrosion protection coating formation process, the surrounding wires are twisted with respect to the core wire to the original state after the individual resin coating has been formed on each of the core wire and the surrounding wires, and the thickness of the resin coating individually formed is about 250 μm and thus it cannot be made so thickly, there is a problem that it cannot be used in such a situation or place that there is the fear that the corrosion protection coating will be damaged by the special structure and thus a thick coating is demanded in order to prevent an exposure of the basis surface by the damage of the coating.

Additionally, in the 3rd prior art, the thick coating is formed in the outer peripheral face of the prestressing strand by applying the double coating corrosion protection. However, the flexibility demanded of the prestressing strand is hindered by the thick coating formed in the outer peripheral face, and not only the tensile strength is hindered to no small extent but also the adhesion strength to the concrete is reduced because the helical groove parts in the outer peripheral face become shallow.

Accordingly, in the prior art methods, there are such problems to be solved that the improvement in the tensile strength should be intended so as not to impair the flexibility and the adhesion strength to the concrete demanded of the prestressing strand, and that the thick coating should be formed in the surface layer part (outer peripheral face) in order to prevent the exposure of the basic surface by the damage of the coating.

SUMMARY OF THE INVENTION

As a concrete means of solving the above problems of the prior art, the invention provides a method of forming corrosion protection double coatings on a prestressing strand, which comprises: a pretreatment process of untwisting the prestressing strand and thereby loosening surrounding wires from a core wire and performing a surface preparation of those wires; a primary painting process of tightening and retwisting the surrounding wires about the core wire, applying a synthetic resin powder paint to surface layer parts except helical groove parts due to the retwisting, heating the paint to adhere, and cooling, thereby forming a resin coating only at a surface layer; a secondary painting process of loosening the surrounding wires of the prestressing strand from the core wire, keeping the core wire and the surrounding wires under a loosened state via a core wire adjusting means, applying the synthetic resin powder paint to an outer peripheral face of each of the core wire and the surrounding wire, heating the paint to adhere evenly, and cooling, thereby forming a respectively individual state resin coating for each of the core wire and the surrounding wires wherein the individual state resin coating for each of the surrounding wires includes a part constituting a double coating; and a finishing process of tightening and retwisting the surrounding wires about the core wire to an original state such that each of the double coating portions is located in the surface layer of the prestressing strand.

The method may include a further process of removing an excessive resin coating formed in the helical groove part after the primary painting process.

The core wire adjusting means always automatically accumulates and adjusts the core wire becoming excessive during the finishing process after the individual state resin coating has been formed on the core wire and the surrounding wires by the secondary painting process, and gives a constant tension to the core wire during retwisting of the surrounding wires.

Further, the invention provides a prestressing strand in which a respectively individual state resin coating is formed in an outer peripheral face of each of a core wire and surrounding wires of the prestressing strand and which is formed by twisting the surrounding wires about the core wire, wherein each of the surrounding wires has double coatings only in a surface layer part under a twisted state. This resultant prestressing strand is produced by using the above method of the invention.

The surrounding wires in the prestressing strand as a finished product has enough flexibility to allow untwisting of the surrounding wires with respect to the core wire and additionally allowing the untwisted surrounding wires to be retwisted to the original twisted state again.

In the invention, after the resin coating has been formed at the surface layer part except the helical groove part of the prestressing strand in the primary painting process, by loosening and untwisting the surrounding wires from the core wire and forming the individual resin coating in the whole outer peripheral face of each of the wires, in each of the surrounding wires the double coatings are formed in its one part, and the double coatings are located in the surface layer part of the finished prestressing strand by retwisting the surrounding wires about the core wire to the original state, so that the surface layer part, of each surrounding wire, except the helical groove parts of the prestressing strand is necessarily coated by the thick resin coating.

And, also when retwisting the surrounding wires to the original state, the resin coatings formed in the outer surface of the core wire and the surrounding wires contacting with the core wire and facing inside are respectively a single coating and one not hindering the retwisting, so that the surrounding wires can be retwisted to the original state rapidly and under a stable state by a twisted habit remaining in the surrounding wire.

DETAILED DESCRIPTION OF THE PREFERRED EMBODIMENT

Figure 1:
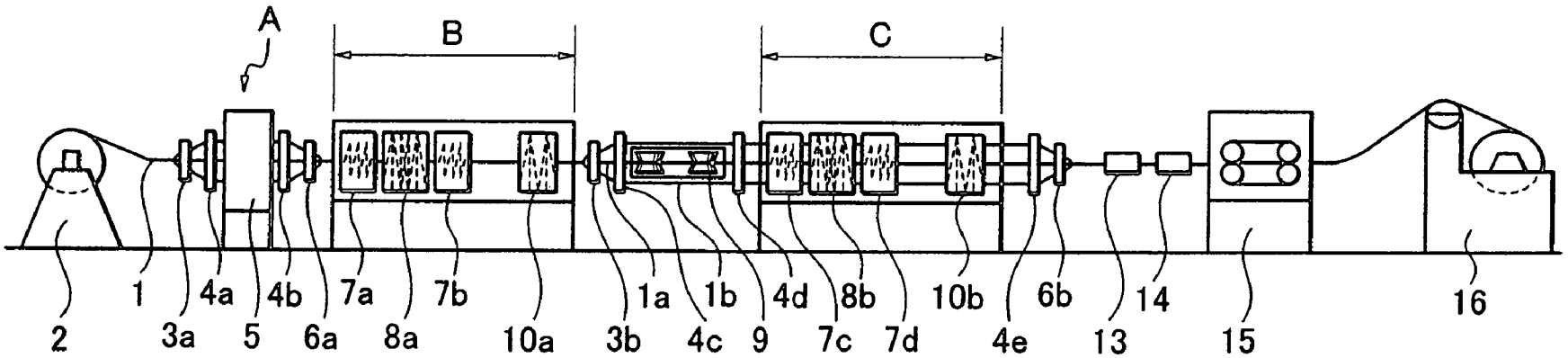
FIG. 1 is a side view schematically showing a working line for performing a method according to an embodiment of the invention.

Next, the invention is explained in detail on the basis of an embodiment shown in the drawings. First, FIG. 1 is a schematic view of a working line for performing a method of forming corrosion protection double coatings on a prestressing strand according to the invention.

Figure 2:
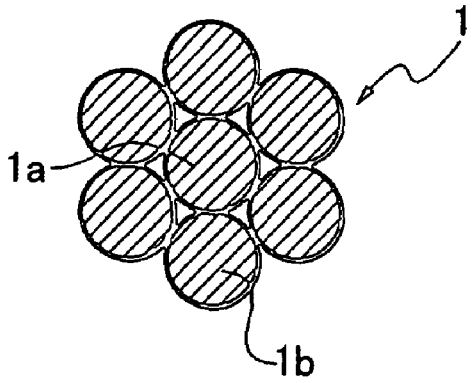
FIG. 2 is a sectional view of a prestressing strand utilized in the embodiment.

And, as shown in FIG. 2, a prestressing strand 1 of one example used in the invention is a prestressing strand constituted by a so-called seven-pieces strand in which the core wire 1*a* exists in a center and six surrounding wires 1*b* are twisted around the outer periphery of the core wire.

Generally, as to the prestressing strand 1 of this kind, a long one is wound in a coiled state, and a corrosion protection coating formation is performed by setting the coiled prestressing strand 1 at a starting end of the working line with the coiled state intact. In this case, the prestressing strand 1 is supplied to the working line by uncoiling successively from its top side front end, passed through a primary painting process (only a surface layer part) and a secondary painting process (whole outer peripheral face of each of the core wire and the surrounding wires) and, in a terminating end part of the working line, successively rewound to the coiled state from the top side front end after the working.

In an outline of processes of the working line according to the invention, there is provided an uncoiler (stand) 2 to which the prestressing strand 1 is set, and the prestressing strand 1 set to the uncoiler 2 is successively sent out toward a next process for the corrosion protection coating formation-working. Namely, after it is passed through a pre-treatment process A (including a shot blast 5), a primary painting process B (utilizing a pre-heating device 7*a*, a powder painting device 8*a*, a post-heating device 7*b* and a cooling device 10*a*), a core wire adjusting means 9 and a secondary painting process C (utilizing a pre-heating device 7*c*, a powder painting device 8*b*, a post-heating device 7*d* and a cooling device 10*b*), and thus returned to its original twisted wires state again, the prestressing strand having been painted is rewound like a coil in a terminating end part side of the working line. Hereunder, each process is described.

Figure 3:
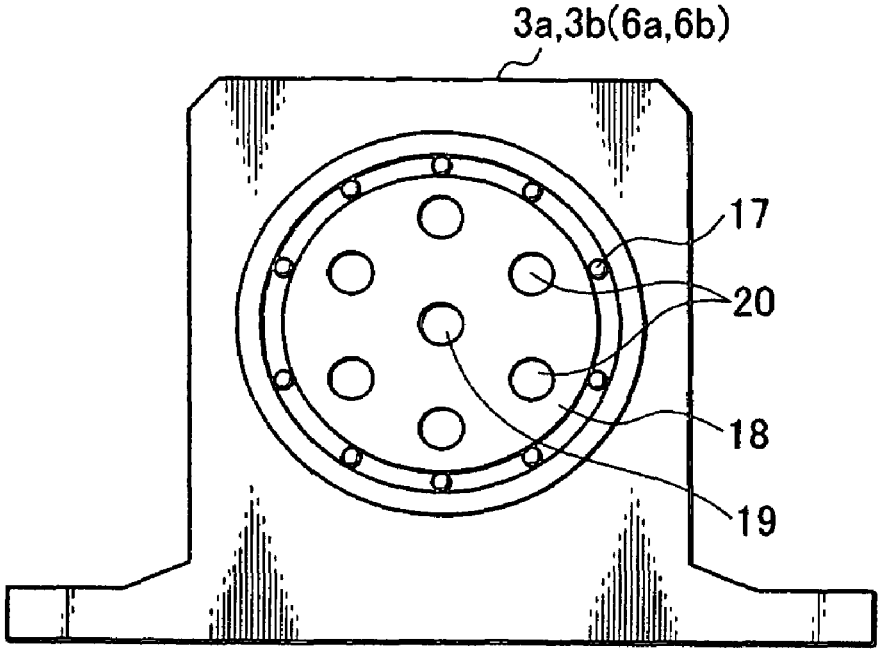
FIG. 3 is a schematic front view showing a loosening device (tightening device) used in the embodiment.
Figure 4:
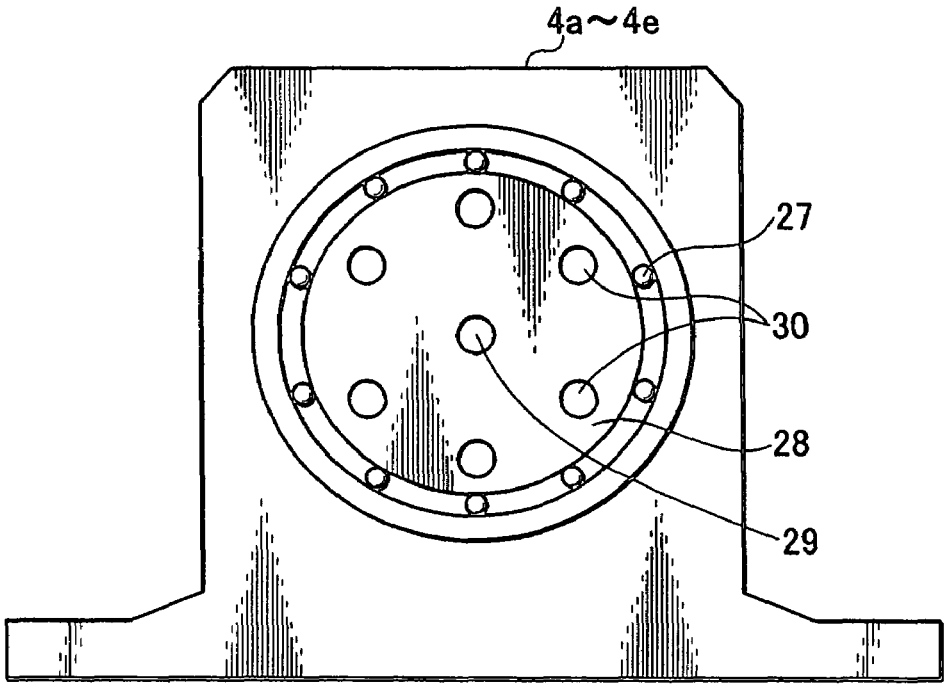
FIG. 4 is a schematic front view showing a wire expander used in the embodiment.

First, on starting a continuous operation, a dummy prestressing strand is manually inserted from the starting end to the terminating end of the working line while having been previously made in a state complying with a category or practice in each process. In this case, in each process, the surrounding wires 1*b* are loosened (untwisted and opened)

from the core wire 1*a* of the prestressing strand 1, the loosened surrounding wires 1*b* are maintained in a separated state, and additionally the surrounding wires 1*b* are tightened (helically wound) with respect to the core wire 1*a* to the original state. As shown in FIG. 3 and FIG. 4, there are used therefor a loosening device 3*a*, a wire expander 4*a* and a tightening device 6*a*, each of which performs each of the above operations. Incidentally, since the loosening device 3*a* and the tightening device 6*a* are substantially the same constitution and only differ in their attaching directions, a concrete constitution is shown in the drawing for only one of them.

FIG. 3 shows the loosening device 3*a* (corresponding also to the tightening device 6*a*). In the loosening device 3*a*, a rotary ring 18 is rotatably disposed through bearings 17. The rotary ring 18 is provided in its center part with a core wire passing hole 19 through which the core wire 1*a* of the prestressing strand 1 is inserted, and provided with six surrounding wire passing holes 20 through which the surrounding wires 1*b* are inserted radially with a desired spacing from the core wire passing hole 19.

Referring to FIG. 4, the wire expander 4*a* is approximately the same constitution as the loosening device 3*a*, and it works for maintaining a separation state of the loosened prestressing strand 1. A rotary ring 28 is rotatably disposed through bearings 27. The rotary ring 28 is provided in its center part with a core wire passing hole 29 through which the core wire 1*a* of the prestressing strand 1 is inserted, and provided with six surrounding wire passing holes 30 through which the surrounding wires 1*b* are inserted radially with a desired spacing from the core wire passing hole 29. The point different from the loosening device 3*a* is that the spacing between the core wire passing hole 29 and the surrounding wire passing holes 30 is wider, and a size of each hole is approximately the same.

And, in the dummy prestressing strand inserted from the starting end to the terminating end of the working line, when passed through the shot blast device 5, each untwisted surrounding wire 1*b* is inserted through one of the surrounding wire passing holes 20 of the loosing device 3*a* before and after the shot blast device and the core wire 1*a* is inserted through the core wire passing hole 19. The inserted surrounding wires 1*b* and core wire 1*a* are respectively inserted through the surrounding wire passing holes 30 and the core wire passing hole 29 of the wire expander 4*a*, passed through an inside of the shot blast device 5 while being kept in the separated state intact, next respectively inserted through the surrounding wire passing holes 30 and the core wire passing hole 29 of another wire expander 4*b* and, after having been additionally inserted through the surrounding wire passing holes 20 and the core wire passing hole 19 of the tightening device 6*a*, retwisted to the original state when drawn out by a predetermined length (about 500 mm). This twisted state is maintained until after passing through a portion of the primary painting process B.

After having been passed through the primary painting process B, the dummy prestressing strand is untwisted again just before the core wire adjusting means 9. The untwisted surrounding wires 1*b* are inserted through the surrounding wire passing holes 20 of a loosening device 3*b*, and the core wire 1*a* is inserted through the core wire passing hole 19. The inserted surrounding wires 1*b* and core wire 1*a* are respectively inserted through the surrounding wire passing holes 30 and the core wire passing hole 29 of a wire expander 4*c*, and an adjustment of the core wire 1*a* is performed by the core wire adjusting means 9. Next, they are passed through the secondary painting process C while maintaining a state in which the surrounding wires 1*b* are separated from the core wire 1*a* intact by a wire expander 4*d*. After having been passed through the secondary painting process C, they are respectively inserted through the surrounding wire passing holes 30 and the core wire passing hole 29 of a wire expander 4*e* and, after having been additionally inserted through the surrounding wire passing holes 20 and the core wire passing hole 19 of a tightening device 6*b*, and retwisted to the original state, they are passed through a coating thickness measuring device 13, a pinhole detecting device 14 and a pulling device 15, and wound by a coiler 16.

With respect to the dummy prestressing strand having been inserted from the starting end to the terminating end of the working line in this manner, a top side front end of the prestressing strand 1 set to the uncoiler 2 is manually untwisted, and continuously connected by butt welding to the dummy prestressing strand having been previously inserted. In this case, as to the mutual core wires 1*a* and the mutual surrounding wires 1*b*, end parts are respectively welded while being butted end-to-end. Especially, the surrounding wires 1*b* are welded while being butted under a state of mutually aligned positions such that their "twisted habits" with respect to the core wire 1*a* approximately coincide. And, after the above-mentioned preparation work has been finished, the continuous operation is started.

First, by continuously operating the working line, the dummy prestressing strand is drawn out to a terminating end side by the pulling device 15 and the coiler 16 in the terminating end side and, with this, the prestressing strand 1 set to the uncoiler 2 is successively drawn out. And, the surrounding wires 1*b* and the core wire 1*a* which have been untwisted and separated by the loosening device 3*a* and the wire expanders 4*a*, 4*b* are passed through the inside of the shot blast device 5 in the pre-treatment process A with their separated states being kept intact.

In this case, the uncoiler 2 accommodates therein a powder brake in order to give a constant tension between it and the pulling device 15 in the terminating end side, and is made into a structure in which a speed of drawing out the prestressing strand 1 set to the uncoiler 2 is adjusted by a brake resistance, thereby giving a necessary tension.

In the shot blast device 5 of the pre-treatment process A, the separated prestressing strand 1 is transferred while being rotated coinciding with a twisting pitch number of the surrounding wires 1*b*. Abrasive materials (steel balls of about 0.3 mmϕ) are projected on the whole outer peripheral faces of the core wire 1*a* and the surrounding wires 1*b*, which are under the separation state in the shot blast device 5, by blades (vanes) rotating at high speed to thereby remove foreign matter, such as oil and rust, adhered to the outer peripheral face of each of the core wire 1*a* and the surrounding wires 1*b*, and perform the surface preparation, e.g., formation of a satin-like basic material state, of the whole outer peripheral faces, thereby improving an anchor effect (adhesion ability) to the painted film (coating) in the painting process in a next process.

After finishing the pretreatment process A, the surrounding wires 1*b* separated by being untwisted are retwisted about the core wire 1*a* to the original state by the tightening device 6*a*, and the prestressing strand 1 thus retwisted is supplied to the primary painting process B as it is. In the primary painting process B, the prestressing strand 1 is heated by the preheating device 7*a*, and a resin coating 26 of a desired thickness is formed only in a surface layer part except helical groove parts by the powder painting device 8*a*. Although the resin coating 26 becomes molten due to the pre-heating, it is made approximately even and smooth as a whole by additionally heating with the post-heating device 7*b*, and sufficiently cooled by the cooling device 10*a* after a gelling time of the resin and a standing time required for curing have elapsed, thereby increasing a surface hardness of the resin coating 26. The surface layer part in this case means an arc-like face in section located outside the surrounding wires 1*b* helically twisted with respect to the core wire 1*a*. Further, the helical groove part refers to a vicinity of a place where the twisted surrounding wires 1*b* mutually contact.

As to the heating devices 7*a*, 7*b*, it is desirable to adopt a high frequency induction heating system by which temperature adjustment can be easily carried out. Further, there is a case where the resin coating 26 can be formed approximately evenly and smoothly by either of the pre-heating or the post-heating in dependence on a kind of the resin, a size of the prestressing strand (thickness of the wire) and the like, so that one heating may suffice in such a case. Additionally, as to the powder painting method, although it may be a gun spray method or a fluidization dip method, in short it is desirable to use an electrostatic powder painting method. This is because there can be applied in a maximum extent such a peculiar phenomenon inherently possessed by the powder painting that it is difficult for the powder paint particles to enter into a place like the groove shape part. And, the paint is suppressed from entering into the helical groove parts by a heating method, a kind, number and disposing position of the electrostatic gun, additionally an air state, a mixing ratio and supplying method of the powder paint, and the like, so that the coating can be formed only in the so-called surface layer parts by adapting such that the coating is not formed in the helical groove part.

In the primary painting process B, a thickness of the resin coating 26 formed only in the surface layer part excepting the helical groove part is in a range of about 150-200 μm. In a case where one part of the resin coating 26 is formed in a bottom part side of the helical groove part, i.e., formed excessively in the vicinity of a place where the surrounding wires 1*b* contact mutually, the excessive resin coating formed in that place is removed before being hardened. In this case, one part of the resin coating 26, i.e., the excessive resin coating formed in the bottom part side of the helical groove part, is removed by passing the prestressing strand 1 through means removing the excessive resin coating, e.g., a desired rotary drawing die 40, just after passing through, for example, the powder painting device 8*a* or just after passing through the post-heating device 7*b*.

Figure 5:
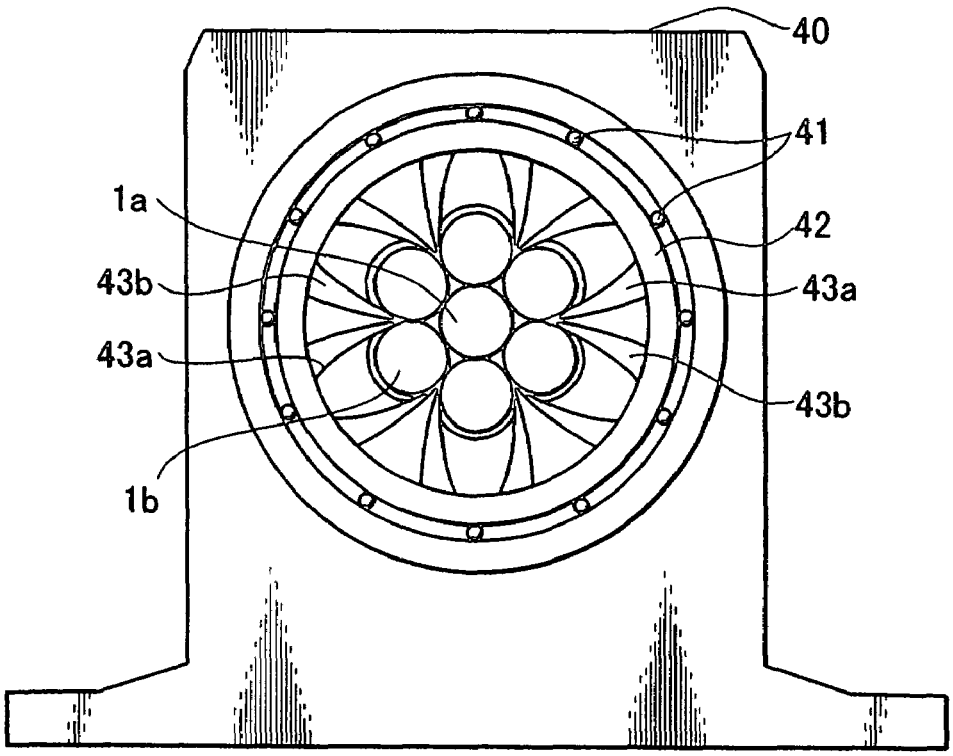
FIG. 5 is a schematic front view showing a rotary drawing die of one example used in the embodiment.
Figure 6:
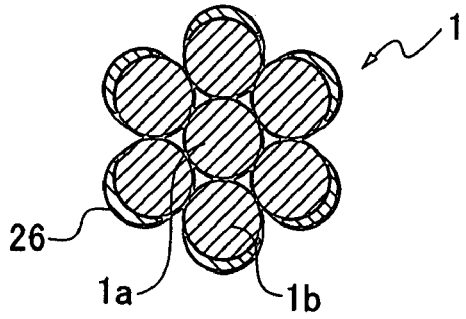
FIG. 6 is a sectional view of the prestressing strand after a primary painting process in the embodiment.

As the removing means, i.e., the rotary drawing die 40, in this case, one shown in FIG. 5 is used for instance. In the drawing die 40, a freely rotatable ring 42 is disposed through bearings 41. Blade parts 43*a*, 43*b* extending toward a center from the ring 42 and respectively having a shape fitting to each helical groove part of the prestressing strand 1 are protrusively formed in pairs inside the ring 42. It suffices if one part of the resin coating formed in each helical groove part, i.e., the coating formed in the bottom part side, is shaved off by the blade parts 43*a*, 43*b*. In short, the prestressing strand 1 in which the resin coating 26 is formed only in the surface layer part excepting the helical groove part is formed into a sectional shape as shown in FIG. 6.

Figure 7:
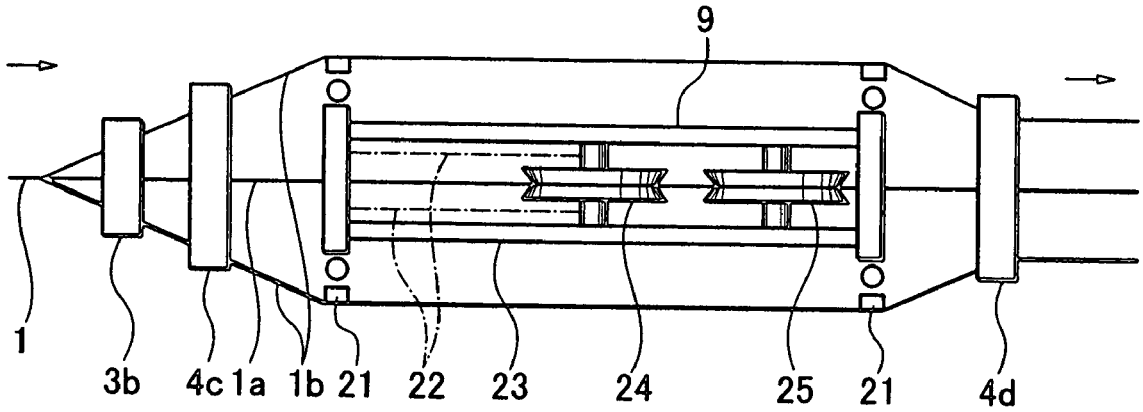
FIG. 7 is a plan view schematically showing a core wire adjusting means of one example used in the embodiment.

And, before being supplied to the secondary painting process C, it is passed through the core wire adjusting means 9 shown in FIG. 7. Namely, in the prestressing strand 1, the surrounding wires 1*b* are successively temporarily untwisted from the circumference of the core wire 1*a* by the loosening device 3*b*. The untwisted surrounding wires 1*b* are separated with a necessary spacing by the wire expander 4*c* and outer rings 21 of the core wire adjusting means 9, and reach the wire expander 4*d* while freely rotating correspondingly to a surrounding wire twisting pitch number of the prestressing strand 1. The core wire 1*a* is passed through the central core wire passing hole 29 in the wire expander 4*c*, U-turned around a fixed pulley 25 of the core wire adjusting means 9, U-turned around a movable pulley 24 again, and reaches the wire expander 4*d*.

An operation distance of the movable pulley 24 or a groove number of the pulley is determined in compliance with an excessive core wire length to be accumulated and absorbed. For example, every pulley is provided with two grooves, an excessive core wire accumulation absorption amount doubles. Since the movable pulley 24 is always pulled under a constant tension to the wire expander 4*c* side by tension adjusting springs 22, it automatically accumulates and absorbs the core wire 1*a* becoming excessive during retwisting of the surrounding wires 1*b* to the original state by the tightening device 6*b*. Further, the fixed pulley 25 and the movable pulley 24 are adapted so as to be freely rotatable without being given a driving force. However, the core wire adjusting means of the invention is not limited to the pulley system.

Figure 8:
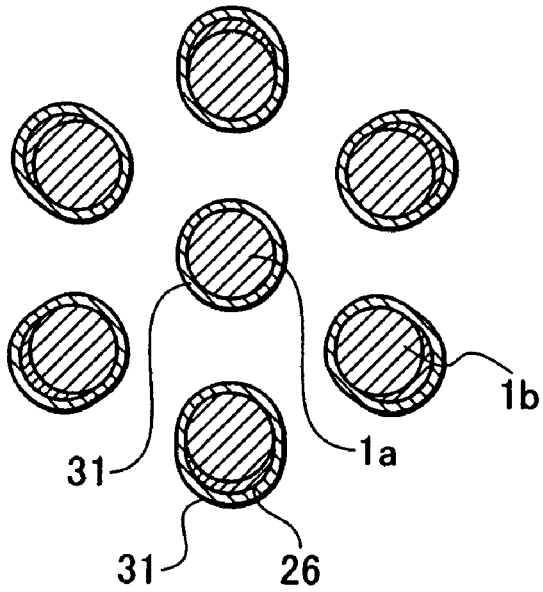
FIG. 8 is a sectional view of the prestressing strand after a secondary painting process in the embodiment.

The surrounding wires 1*b* having passed through the core wire adjusting means 9 are separated with the necessary spacing by the wire expanders 4*d*, 4*e*. The core wire 1*a* is supplied to the secondary painting process C while maintaining the separated state and rotating in the surrounding wire twisting pitch number via the central core wire passing holes 29 in the wire expanders 4*d*, 4*e*. In the secondary painting process C, the heating is applied by the pre-heating device 7*c*, and a resin coating 31 is formed over the whole outer peripheral face of each of the core wire 1*a* and the surrounding wires 1*b* under an independent state by the powder painting device 8*b*. Although the resin coating 31 becomes molten due to the pre-heating, it is made approximately even and smooth as a whole by additionally heating with the post-heating device 7*d* and, as shown in FIG. 8, the resin coating 31 is formed under a state wholly enclosing the resin coating 26 formed in the primary painting process B, and sufficiently cooled by the cooling device 10*b* after the gelling time of the resin and the standing time required for curing have elapsed, thereby increasing the surface hardness of the resin coating 31.

In this manner, by forming the resin coating 31 in the secondary painting process C on the resin coating 26 formed in the primary painting process B and a gelation by the heating, a double-bond coating is formed. Incidentally, as to the heating device, it is desirable to adopt the high frequency induction heating system by which the temperature adjustment is easy. Further, there is a case where only either the pre-heating or the post-heating may suffice in dependence on the kind and mixing ratio of the resin, the size of the prestressing strand and the like.

Figure 9:
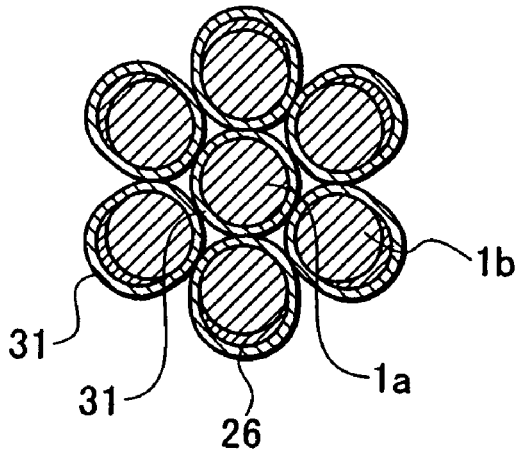
FIG. 9 is a sectional view of the prestressing strand in which surrounding wires have been retwisted about a core wire to an original state after the secondary painting process.
Figure 10:
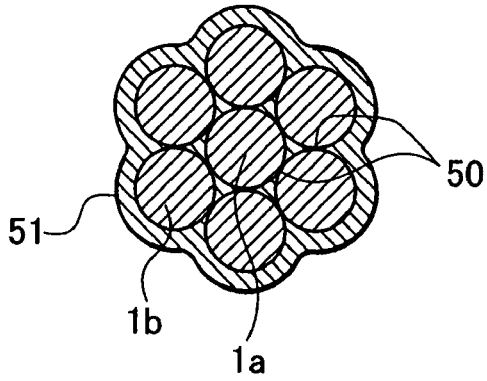
Fig. 10 PRIOR ART
FIG. 10 is a sectional view of a prestressing strand used in a first prior art method.
Figure 11:
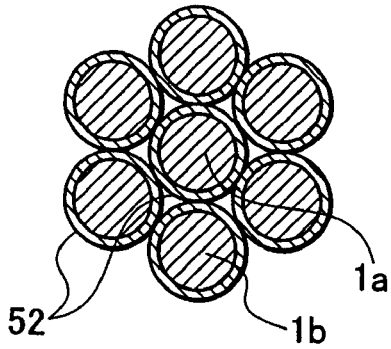
Fig. 11 PRIOR ART
FIG. 11 is a sectional view of a prestressing strand used in a second prior art method.
Figure 12:
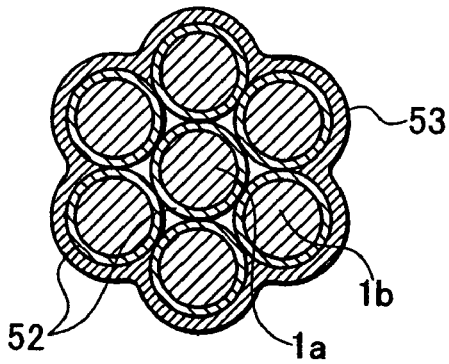
Fig. 12 PRIOR ART
FIG. 12 is a sectional view of a prestressing strand used in a third prior art method.

A thickness of the resin coating 31 formed in the secondary painting process C is about 250±50 μm. After the resin coating 31 has been formed in the secondary painting process C, the surrounding wires 1*b* are retwisted about the core wire 1*a* to the original state by the tightening device 6*b*. In this case, the surrounding wires 1*b* can be rapidly twisted to the original state because the twisted habit remains as it is. FIG. 9 shows a sectional shape of the prestressing strand 1 having been retwisted to the original state. The double coatings are located only in the so-called surface layer part protruding outside, except portions corresponding to the helical groove parts of the prestressing strand 1.

In this case, since the coating thickness of the primary painting is in a range of about 150±50 μm and that of the secondary painting is about 250±50 μm, a thickness of the double-bond coating becomes in a range of about 400±100 μm. However, a thickness of the coating formed on the core wire 1*a* located inside and a thickness of the coating at a twisted portion of the surrounding wires 1*b* contacting with the core wire 1*a* are respectively in the range of 250±50 μm. Since the double coatings are located in an outside deviated from the contacting face due to the twisting, the surrounding wires 1*b* have a coating thickness by which they can be rapidly and stably retwisted about the core wire 1*a* under the same pitch.

As to the prestressing strand after the primary and secondary painting coatings have been formed, its surface film thickness is measured by the coating thickness measuring device 13 as a coating test device. If the film thickness is outside a set allowable value, an alarm for notifying this fact is emitted, and there is emitted a signal about whether it is below the allowable value or beyond the allowable value. Additionally, a state of the coating is tested by the pinhole-detecting device 14. A method of the test is so adapted that, in a case where the pinhole is detected by using a non-contact type, e.g., optical, detecting means which does not cause damage to the coating, a marking is applied to that detected position and an alarm signal is emitted.

The prestressing strand 1 in which the double coatings have been formed only in the surface layer part tested in this manner is pulled by the pulling device 15 having a structure so as not to injure the resin coating in which upper and lower endless belts are disposed. Further, the pulling device 15 uses inverter motors capable of freely changing a line speed to function also as a speed-setting device of the working line. And, the coating thickness varies dependent on the line speed, so that an optional thickness of the coating can be formed by selecting the line speed.

The prestressing strand 1 with the double coatings formed and sent out of the pulling device 15 is wound always under a constant tension by a torque motor of the coiler 16, and accordingly, the winding tension does not change even if a coil diameter of the prestressing strand 1 becomes large.

When the prestressing strand 1 set in the uncoiler 2 performing the continuous operation has become null, a drive of the working line is stopped, the coating formation is once stopped, and a fresh prestressing strand is provided to the uncoiler 2. An end side rear end of the previous prestressing strand 1 and a top side front end of the prestressing strand 1 freshly set are connected by performing the butt welding, and the operation is started again.

In the prestressing strand 1 formed in this manner, since the resin coating 31 is formed on each of the core wire 1*a* and the surrounding wires 1*b* under an independent or individual state, not only is the flexibility demanded for this kind of prestressing strand not lost but also corrosion resistance and tensile strength can be improved. Further, the double coating portions are located in the outer peripheral face when the surrounding wires 1*b* have been retwisted to the original state, and accordingly the helical groove parts due to the retwisting become deeper, so that the adhesion strength to the concrete is improved, and it can sufficiently withstand the use in a region or place where there is a fear of coating damage in the special structure.

In this embodiment, an example has been described in which the primary coating formation and the secondary coating formation are continuously performed, but it is not limited to this. For example, it is also possible to perform the primary coating formation and the secondary coating formation individually and separately. Further, an example bas been described in which the dummy prestressing strand is used as the preparation stage of the operation starting, but it is not limited to this. The top side front end of the prestressing strand, which is to be treated and set to the uncoiler 2, may be manually untwisted, and it may be inserted through up to the terminating end side in compliance with the category of each process, so that it is a matter of course that there is a case where the dummy prestressing strand is not used.

According to the method of the invention as explained above, there is brought about excellent advantages that, even after the double coatings have been formed, it is easy to retwist the surrounding wires to the. original state again, and moreover that the thick double coatings can be easily formed without hindering at all the properties of the flexibility and the adhesion strength to the concrete, which are deemed to be the largest characteristics of the prestressing strand, in order to protect an outer surface (the surface layer part) exposed to the fear of the coating damage in the special structure.

Further, according to the prestressing strand of the invention, it has the flexibility demanded of the prestressing strand and has the corrosion resistance and the tensile strength because the core wire and the surrounding wires are individually resin-coated. Also, it can withstand the coating damage in the special structure because the double coatings are formed in the surface layer part of the prestressing strand and, additionally, the adhesion strength to the concrete is more improved because the comparatively deep helical groove parts are formed in the outer surface.

Especially, the surrounding wires in the prestressing strand as a finished product has enough flexibility and it is possible to untwist the surrounding wires with respect to the core wire and additionally the untwisted surrounding wires can be retwisted to the original twisted state again. Further, excellent properties in both of the corrosion resistance and the tensile strength can be given to the prestressing strand of the invention while maintaining the flexibility.

What is claimed is:

1. A prestressing strand comprising:

a plurality of wires, each having an outer peripheral face;

wherein said plurality of wires includes a core wire, and surrounding wires twisted around said core wire;

wherein each of said plurality of wires has an individual outermost resin coating formed individually about said outer peripheral face thereof and not about any other of said plurality of wires, such that each of said outermost resin coatings of said plurality of wires is independent of said outermost resin coatings of the other of said plurality of wires so that said surrounding wires having said outermost resin coatings thereon can be untwisted from said core wire having said outermost resin coating thereon;

wherein each of said surrounding wires has a second resin coating at only a surface layer part under a twisted state, such that each of said surrounding wires has a double resin coating only at said surface layer part thereof under the twisted state; and wherein, for each of said surrounding wires, said second resin coating thereof is formed inwardly of said outermost resin coating thereof.

2. A prestressing strand according to claim 1 wherein said core wire and said surrounding wires are configured such that said surrounding wires can be untwisted with respect to said core wire and then retwisted to the original twisted state again.

* * * * *